United States Patent [19]

Jakubicki

[11] Patent Number: 4,855,067

[45] Date of Patent: Aug. 8, 1989

[54] HOUSEHOLD CLEANING COMPOSITION

[75] Inventor: Gary J. Jakubicki, Robbinsville, N.J.

[73] Assignee: Colgate-Palmolive Company, New York, N.Y.

[21] Appl. No.: 192,168

[22] Filed: May 10, 1988

[51] Int. Cl.[4] ..... C11D 3/37

[52] U.S. Cl. ..... 252/174.25; 252/174.23; 252/DIG. 2; 252/DIG. 14

[58] Field of Search ..... 252/174.25, 174.23, 252/174.24, DIG. 2, DIG. 5, DIG. 13, DIG. 14, DIG. 16, 88, 128, 131, 140

[56] References Cited

U.S. PATENT DOCUMENTS

| | | | |
|---|---|---|---|
| 3,053,646 | 9/1962 | Roth | 51/298 |
| 3,326,807 | 6/1967 | Guest et al. | 252/152 |
| 3,645,904 | 2/1972 | Beach | 252/89 |
| 3,956,162 | 5/1976 | Lautenberger | 252/88 |
| 4,108,780 | 8/1978 | Thomas | 252/88 |
| 4,434,067 | 2/1984 | Malone et al. | 252/88 |
| 4,481,126 | 11/1984 | Trinh et al. | 252/174.23 |
| 4,613,379 | 9/1986 | Su et al. | 252/174.23 |
| 4,693,840 | 9/1987 | Trinh et al. | 252/174.23 |
| 4,772,425 | 9/1988 | Chirash et al. | 252/174.25 |

OTHER PUBLICATIONS

Manufacturer's Specification Sheet on Blendex 586/Borg Warner, which relates to Heat Distortion Modifiers, pre May 1988.

*Primary Examiner*—Paul R. Michl
*Assistant Examiner*—Hoa Van Le
*Attorney, Agent, or Firm*—Robert Sullivan; Murray Grill; Richard Ancel

[57] ABSTRACT

A non-scratching household cleaning composition containing as a major ingredient poly[alpha-methylstyrene-styrene-acrylonitrile] commercially available as "BLENDEX 586". This ingredient is blended with a conventional surfactant and builder. The system can also contain a solvent or bleach system. The BLENDEX 586 component is present as finely divided particles having a size range of about 44-to-420 microns.

4 Claims, No Drawings

HOUSEHOLD CLEANING COMPOSITION

BACKGROUND OF THE INVENTION

The present invention is essentially a nonabrasive household cleaning composition that includes finely divided particles of a thermoplastic resin.

U.S. Pat. No. 4,537,604 to Dawson discloses a scouring cleaning composition having agglomerates of finely divided abrasive material in an organic binder.

U.S. Pat. Nos. 4,481,126 and 4,693,840 to Trinh et al relate to substantially nonabrasive liquid car cleansers which are comprised of polymeric particulate materials.

U.S. Pat. No. 3,645,904 to Beach describes a skin cleanser containing particles of polyethylene.

U.S. Pat. No. 4,508,635 to Clarke describes a liquid general purpose cleanser which contains 5% alcohol esterified resin copolymer.

U.S. Pat. No. 3,326,807 to Guest et al relates to detergent toilet preparations containing an aqueous dispersion of a polymer or copolymer of styrene.

U.S. Pat. No. 4,434,067 to Malone et al describes a cleanser for textile fabrics comprised of a particulate polymeric material prepared from synthetic organic polymers.

SUMMARY OF THE INVENTION

The present invention is a substantially nonabrasive household cleaning composition which cleans household utensils, tile etc. The preferred formulation is a cream cleanser which contains as a major ingredient poly[alpha-methylstyrene-styrene-acrylonitrile] commercially available under the trade name BLENDEX 586.

An object of this invention is to provide a substantially nonabrasive cream household cleanser which can be used frequently on household utensils and won't damage even plastic utensils. Another object of the invention is to provide a cream cleaning composition with organic polymeric solids.

DETAILED DESCRIPTION OF THE INVENTION

The essential ingredient of the cleaning composition of the instant invention is the terpolymer available under the trade name BLENDEX 586. The vendors describe the composition as a glass poly[alpha-methylstyrene-styrene-acrylonitrile] thermoplastic polymeric resin. For purposes of simplicity this ingredient will be identified by the acryonym AMSAN in the instant application.

The particle size range of the AMSAN is important. The AMSAN must have a particle size distribution between 40 and 325 mesh (44-to-420 microns). The preferred particle size is about 60-to-325 mesh (44-to-250 microns).

The physical properties of AMSAN ingredient are set out in Table 1 below

TABLE 1

| | |
|---|---|
| Glass Transition Temperature (°F./°C.) | 257/125 |
| Refractive Index | 1.57 |
| Specific Gravity | 1.09 |
| Hardness (Rockwell R) | 123 |
| Bulk Density (lbs/ft.$^3$) | 20 |

It has been shown by comparative tests on the AMSAN that this ingredient is harder than polyvinyl chloride but not as hard as calcite. The AMSAN ingredient, when blended into a conventional detergent can be used to clean household utensils, for example without any problem with abrasion of these utensils. The chemical formulations containing AMSAN have no tendency to scratch even polymeric surfaces.

The cleanser formulations of the instant application can range from powders to paste to liquid consistencies depending on the level of AMSAN in the formulation, or AMSAN can be used at relatively low levels in gelled compositions. The particle size of the AMSAN could be reduced by grinding or screening through finer mesh screens (i.e. 60 mesh - 250 microns) and still maintain parity scouring performance when compared to commercially available compositions.

The AMSAN component is present as 5-to-95 percent of the formulation preferably about 5-to-25 percent. A typical formulation when the composition is a cream as set out in Table 2 below

TABLE 2

| Scouring Cream Composition | % |
|---|---|
| AMSAN-screened thru 40 mesh | 35.00 |
| Water (DI) | 51.32 |
| FD&C Yellow #5 (2% Solution) | 0.20 |
| Sodium Sulfate (anhydrous) | 1.00 |
| Sodium Carbonate (anhydrous) | 1.00 |
| Sorbitol (70% solution) | 2.00 |
| N—Silicate (1:3.26 41 Be.) - (PQ) | 1.00 |
| Sodium Dodecylbenzenesulfonate (50% slurry) | 6.18 |
| Ethoxylated cocomonoethanolamide 2:1 (Amidox C-2) | 2.00 |
| Formalin | 0.10 |
| Lemon Perfume | 0.20 |
| total | 100.00 |

A typical formulation of the composition as a liquid is set out in Table 3 below

TABLE 3

| Scouring Liquid Composition | % |
|---|---|
| Ethoxylated Alcohol Sulfate | 9.940 |
| Lauric Myristic Monoethanolamide/SXS Blend | 3.600 |
| Sodium Dodecylbenzenesulfonate (50% slurry) | 18.500 |
| Amsan-Screened thru 60 mesh | 5.000 |
| Water | 62.560 |
| Color Solution | 0.100 |
| Perfume | 0.200 |
| Formalin | 0.100 |
| total | 100.000 |

A typical powder formulation is set out in Table 4 below

TABLE 4

| Scouring Powder Composition | % |
|---|---|
| AMSAN - screened thru 60 mesh | 93.80 |
| Sodium Carbonate (anhydrous) | 3.00 |
| Sodium Dodecylbenzene Sulfonate (Nansa HS85S) | 2.80 |
| Colorant | 0.20 |
| Perfume | 0.20 |
| | 100.00 |

These compositions are typical and not intended to be descriptive. Any suitable surfactant, builder and/or solvent/bleach system may be used in formulating the composition.

As pointed out above the essential feature of the cleansing composition of the instant application resides in the ability to clean soiled surfaces without abrading the surface. The ability to clean soiled surfaces was demonstrated in a series of runs. The data collected is set out in Example 1.

EXAMPLE 1

In this example Comstock cherry pie filling was blended to smooth consistency and applied as a thin even coat to one side of a 4"×3¼" glass plate. The plates were then baked in an oven for 7–10 minutes at 375° F. A hand held twin sponge holder was then used for the cleaning test, Three and a half grams of the composition described in table 2 above and a commercial composition containing calcite abrasive were applied to premoistened sponges. The plates were then scrubbed to 150 strokes using heavy pressure. The composition in Table 2 was compared to the commercially available composition in duplicate runs using the same test. The comparable results are set out in Table five below

TABLE V

| Percent cleaning as determined by area of soil removal | | | |
|---|---|---|---|
| | Run 1 | Run 2 | Average |
| Commercial formulation | 9 | 34 | 22 |
| Formulation of Example 1 | 50 | 77 | 64 |

It is apparent from this data that the cleansing composition of the instant application is substantially better than the commercially available scrubbing formulation. The composition of Table 2 cleaned substantially greater area of soil than the commercially available formulation. On average the formulation of Example 2 cleans as much as 3 times as much surface as the commercially available formulation.

The superior non-scratch properties of the formulation of Table 2 was demonstrated in an abrasion test.

EXAMPLE 2

In this example the percent gloss reduction was measured. This measurement was carried out using beige polymethylmethacrylate tiles available from U.S. Steel Corporation as the test substrate. Gloss measurements were made using a Gardner 20° glossimeter. The percent of gloss reduction is calculated by the following formula.

$$\frac{\text{Initial Gloss} - \text{Final Gloss}}{\text{Initial Gloss}} \times 100 = \text{percent gloss reduction}$$

The percent gloss reduction was measured by applying 3.5 grams of the commercial product and 3.5 grams of the product of Table 2 to premoistened sponges of the Gardner abrasion Machine equipped with a twin sponge holder. The test was run for 150 cycles with an applied pressure of 0.25 lbs/in.$^2$ of sponge surface. The data collected are set out in Table 6 below.

TABLE VI

| ABRASION TEST PERCENT GLOSS REDUCTION | | | |
|---|---|---|---|
| | Run I | Run II | Average |
| Commercial formulation | 7.8 | 12.5 | 10 |
| Formulation of Example II | 0.2 | — | 0.1 |

It is apparent in the data that the composition of the instant invention is substantially better than the commercially available product. The gloss reduction of the product of Table 2 was better by a factor of 100 than the gloss reduction of the commercially available composition.

Obviously many modifications and variations of the invention may be made without disparting from the essence and scope thereof and only such limitations should be applied as are indicated in the claims.

What is claimed is:

1. A household cleaning composition which comprises: in admixture with a surfactant, finely divided particles of a synthetic thermoplastic resin further comprising terpolymers produced from alpha-methylstyrene, styrene, and acrylonitrile homopolymers, having a density of about 20 pounds per cubic foot, a particle size distribution between about 40–60 mesh, a Rockwell R hardness of about 120–125, wherein said composition is a semi-solid household cleansing cream containing between 5 and 95 percent of said plastic particles dispersed therein and whereby the particles of the synthetic plastic material leave the surfaces cleaned substantially free of abrasion.

2. A household cleaning composition which comprises: in admixture with a surfactant, finely divided particles of a synthetic thermoplastic resin further comprising terpolymers produced from alpha-methylstyrene, styrene, and acrylonitrile homopolymers, having a density of about 20 pounds per cubic foot, a particle size distribution in the range of between 40–60 mesh, a Rockwell R hardness of about 120–125, wherein said composition is a waterless type cleaner containing between 5 and 95 percent of said plastic particles dispersed therein and whereby the particle of the synthetic plastic material leave the surfaces cleaned substantially free of abrasion.

3. The method of soil removal with a household surface cleaning composition which is substantially free of non-resilient abrasive materials and which is an admixture with finely divided particles of a synthetic thermoplastic resin composition further comprising terpolymers produced from alpha-methylstyrene, styrene, and acrylonitrile homopolymers, having a density of about 20 pounds per cubic foot, a particle size distribution in the range between about 40–60 mesh, a Rockwell R hardness of about 120–125, wherein said composition is a semi-solid household cleansing cream containing between 5 and 95 percent of said plastic particles dispersed therein and whereby the particles of synthetic thermoplastic material leave the said surfaces substantially free of abrasion.

4. The method of soil removal with a household surface cleaning composition which is substantially free of non-resilient abrasive materials and which is an admixture with finely divided particles of a synthetic thermoplastic resin further comprising terpolymers produced from alpha-methylstyrene, styrene, and acrylonitrile homopolymers, having a density of about 20 pounds per cubic foot, a particle size distribution in the range between about 40–60 mesh, a Rockwell R hardness of about 120–125, wherein said composition is a waterless type household cleanser containing between 5 and 95 percent of said plastic particles dispersed therein and whereby the particles of synthetic thermoplastic material leave the said surfaces substantially free of abrasion.

* * * * *